US011297911B2

(12) United States Patent
Tremblay et al.

(10) Patent No.: US 11,297,911 B2
(45) Date of Patent: Apr. 12, 2022

(54) EARRING BACKING WITHOUT HOLE

(71) Applicants: Linda Tremblay, Brossard (CA); Chantale Dufour, Saguenay (CA)

(72) Inventors: Linda Tremblay, Brossard (CA); Chantale Dufour, Saguenay (CA)

( * ) Notice: Subject to any disclaimer, the term of this patent is extended or adjusted under 35 U.S.C. 154(b) by 0 days.

(21) Appl. No.: 16/781,073

(22) Filed: Feb. 4, 2020

(65) Prior Publication Data

US 2020/0253342 A1 Aug. 13, 2020

(51) Int. Cl.
*A44C 7/00* (2006.01)

(52) U.S. Cl.
CPC ..... *A44C 7/003* (2013.01)

(58) Field of Classification Search
CPC ..... A44C 7/003; Y10T 24/41; A63B 37/00
See application file for complete search history.

(56) References Cited

U.S. PATENT DOCUMENTS 3,040,406 A * 6/1962 Artzt ..... A44C 7/003 24/453
3,241,834 A * 3/1966 Stingley ..... A63B 37/00 473/569
3,563,056 A * 2/1971 Noel ..... A44C 7/003 63/12
3,630,048 A * 12/1971 Masters ..... A44C 7/003 63/12
3,945,089 A * 3/1976 Gagnon ..... A44B 9/10 24/705
4,517,816 A * 5/1985 Hess ..... A44C 7/003 24/705
4,593,540 A * 6/1986 Cuvar ..... A44C 7/003 411/337
4,598,909 A * 7/1986 Ventura ..... A63B 37/02 273/DIG. 29
4,694,664 A * 9/1987 Elsener ..... A44C 7/00 63/12
4,907,425 A * 3/1990 Elkin ..... A44C 7/003 264/154
5,170,542 A * 12/1992 Greenberg ..... A44C 7/003 24/705
5,201,197 A * 4/1993 Bakker ..... A44C 7/003 63/12
5,816,073 A * 10/1998 Bardisbanyan ..... A44C 7/00 63/12
5,828,757 A * 10/1998 Michalsen ..... H04R 25/502 381/328
5,893,278 A * 4/1999 Float ..... A44C 7/003 24/705
7,347,065 B1 * 3/2008 DeGolyer ..... A44C 9/0046 63/12

(Continued)

*Primary Examiner* — Robert Sandy
*Assistant Examiner* — Louis A Mercado
(74) *Attorney, Agent, or Firm* — Ingenium Patents LLC; Peter R. Kramer

(57) ABSTRACT

This disclosure relates to the use of anmornamental elastomeric earring back fastener comprised of silicone, silicone rubber or rubber wherein the earring back fastener is without any hole which can receive an earring post in order to support an earring to an earlobe. The earring backing can may include sphere, square, rectangle rhombus, or other ornamental shapes. The hardness of the earring backing may vary between 10 shore A to 90 shore A, but 20 shore A to 40 shore A is preferred.

13 Claims, 4 Drawing Sheets

(56) References Cited

U.S. PATENT DOCUMENTS

| | | | | |
|---|---|---|---|---|
| 8,695,183 | B2 * | 4/2014 | Kent | A44C 7/003 24/705 |
| 9,226,552 | B1 * | 1/2016 | Makhoulian | A44C 7/003 |
| 9,351,545 | B2 * | 5/2016 | Kent | A44C 7/003 |
| 9,402,449 | B1 * | 8/2016 | Kim | A44C 7/00 |
| 2004/0237584 | A1 * | 12/2004 | Lee | A44C 7/003 63/12 |
| 2005/0092022 | A1 * | 5/2005 | Umehara | A44B 9/16 63/35 |
| 2006/0005577 | A1 * | 1/2006 | Stuart | A44C 7/002 63/12 |
| 2017/0079387 | A1 * | 3/2017 | Dobashi | A44C 7/003 |

* cited by examiner

FIG. 11
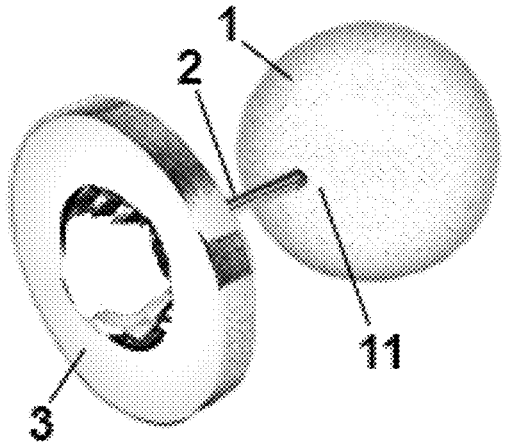
FIG. 12
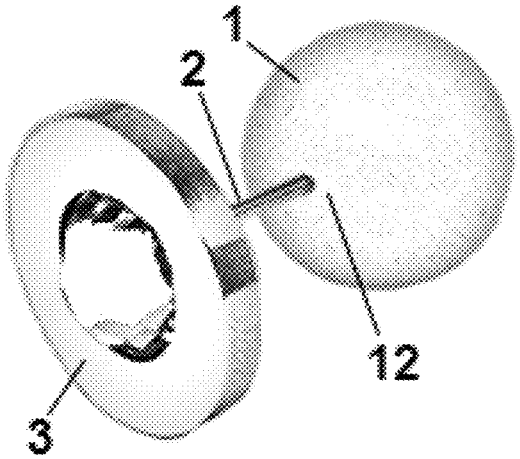

EARRING BACKING WITHOUT HOLE

REFERENCES CITED

U.S. Patent Documents

| | | | |
|---|---|---|---|
| 3,040,406 A | June 1962 | Artzt | A47G 1/22 |
| 3,563,056 A | February 1971 | Noel | A44C 7/003 |
| 3,630,048 A | December 1971 | Masters | A44C 7/003 |
| 3,945,089 A | March 1976 | Gagnon | A44B 9/10 |
| 4,517,816 | May 1985 | Hess | A44C 7/00 |
| 4,593,540 | June 1986 | Cuvar | A44C 7/00 |
| 4,694,664 A | September 1987 | Elsener | A44C 7/00 |
| 5,170,542 A | December 1992 | Greenberg | A44C 7/003 |
| 5,201,197 A | April 1993 | Bakker | A44C 7/003 |
| 5,816,073 A | October 1998 | Bardisbanyan | A44C 7/00 |
| 5,828,757 A | October 1998 | Michalsen | H04R 25/502 |
| 5,893,278 A | April 1999 | Float et al. | A44C 7/003 |
| 7,347,065 B2 | March 2008 | DeGolyer | A44C 9/0046 |
| 8,695,183 B2 | April 2014 | Kent | A44C 7/00 |
| 9,351,545 B2 | May 2016 | Kent | A44C 7/00 |
| 9,226,552 B1 | January 2016 | Richline Group | A44C 7/00 |
| 9,402,449 B1 | August 2016 | Won | A44C 7/00 |
| 2004/0237584 A1 | December 2005 | Lee | A44C 7/003 |
| 2005/0092022 A1 | May 2005 | Umehara | A44C 1/00 |
| 2006/0005577 A1 | January 2006 | Stuart | A44C 7/002 |
| 2017/0079387 A1 | March 2017 | Hidetaka | A44C 7/00 |

FIELDS OF INVENTION

Embodiment of the invention related to, earring back-clip, earring back-fastener or earring back-support commonly called "earring backing".

BACKGROUND

Historically, earrings are used to adorned ears since several thousand of years. Typically, earring includes a decorative frontispiece secured to a post which passes through a small opening in the earlobe and is fixed to a fastener at the back of the lobe. The back-fastener is a mechanism that allow the earring post to pass through a hole to secure the earring in place behind the lobe. More specifically this back-fastener mechanism is called earring backing and contains a hole.

BRIEF SUMMARY OF THE INVENTION

The ornamental earring backing without hole of the present invention can replace all other types of earring back-fastener or earring back-support, and this, in order to support an earring with post to an earlobe.

What distinguishes our ornamental earring backing from all other types of earring back-fastener or earring back-support known in the prior art or on the market, is that our earring backing is without hole, thus allowing the post of the earring to be inserted no matter where. The ornamental earring backing is fix to the earring by inserting the post without having to search for the hole. In addition, the type of elastomer of our ornamental earring backing adhere perfectly to the metal post of all types of earrings. This elastomer also allows to be repeatedly penetrated by a post while maintaining a good outer surface finish.

Furthermore, by combining the adherent nature of the elastomer and the appropriate choice of dimension of our earring backing, it is possible to support an earring very well, even for people with stretched, enlarged or transformed lobes ("piercing"). The superior support provided by the ornamental earring backing of the present invention also allows to avoid exerting additional and uncomfortable pressure on the earlobe in order to keep the earring in good position.

Being of all shapes and diameters, when combined with an earring, the ornamental earring backing of the present invention can be worn both, in front of and behind the earlobe.

As the ornamental earring backing of the present invention is constantly in contact with the earlobe skin, it is preferably hypoallergenic and medical grade certified.

BRIEF DESCRIPTON OF THE DRAWINGS

Figure 6:
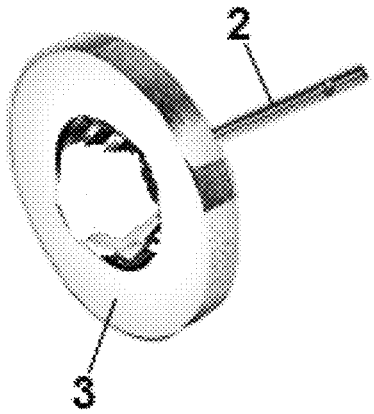

FIG. 6 illustrates a standard earring 3 with its post 2. It is the post 2 which is fixed to the ornamental earring backing to support the earring to the earlobe.

FIGS. 7 to 12 illustrate and demonstrate that the post 2 of the earring 3 penetrate into each of the six sides of the ornamental earring backing 1 without hole.

DETAILLED DESCRIPTION OF THE INVENTION

The emphasis of this section explains the invention principle, the drawings are not to scale and only show an example of the possible dimension and shape of our ornamental earring backing.

We will clearly demonstrate what distinguishes our ornamental earring backing from any other earring back-fastener. The following detailed description of the drawing will explain how our ornamental earring backing without hole works.

Figure 1:
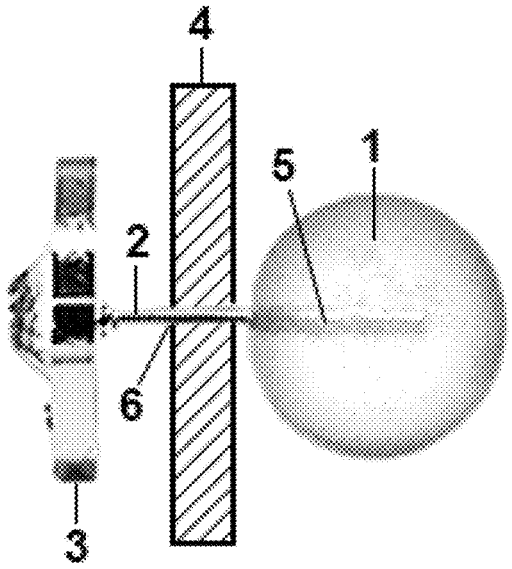
FIG. 1 illustrates the ornamental earring backing 1 in use with a standard earring with post.

FIG. 1 shows how the ornamental earring backing 1, here spherical and translucent, is used with an earring. The post 2 of the earring 3 is inserted into the earlobe 4 through the hole of the earlobe 6 and penetrate the ornamental earring back 1 without a hole. We notice very clearly through the translucent ornamental earring back 1, that the post 2 is partly inside 5 of the ornamental earring backing 1.

Figure 2:
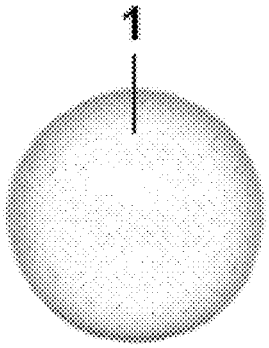
FIG. 2 illustrates the ornamental earring backing 1, here it is spherical.

FIG. 2 shows the ornamental earring backing 1. The ornamental earring backing 1 is composed of an elastomer comprised of silicone, silicone rubber or rubber and has hardness that can vary from 10 shore A to 90 shore A, but is preferably between 20 shore A and 40 shore A. This same ornamental earring backing 1 can also have different shapes and dimensions. The different shapes include but are not limited to sphere, square, rectangle, and rhombus. The ornamental backing can vary in diameter from 5 mm to 20 mm, but preferably between 10 mm and 20 mm to ensure superior support of an earring to an earlobe.

Figure 3:
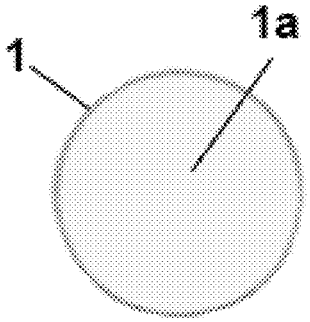
FIG. 3 illustrates a cutaway perspective view of the ornamental earring backing 1.

FIG. 3 is a cutaway perspective view of the ornamental earring backing 1. It illustrates and demonstrates that there is no hole in the ornamental earring backing 1, this one being completely filled with the elastomer 1*a*.

Figure 4:
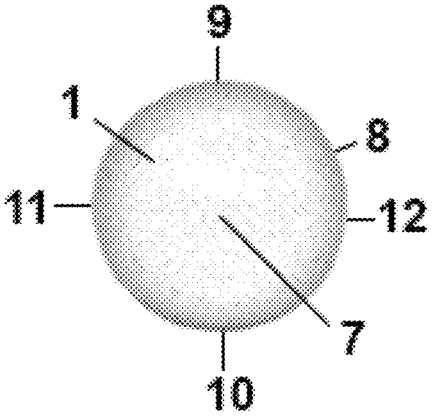
FIG. 4 illustrates this same ornamental earring backing 1 where each of its different sides are identified.

FIG. 4 illustrates the six sides of the ornamental earring backing 1, namely the front side 7, the rear side 8, the top side 9, the bottom side 10, the left side 11 and the right side 12 which will allow to demonstrate in the subsequent figures, that the ornamental earring backing 1 does not actually contains or has any hole.

Figure 5:
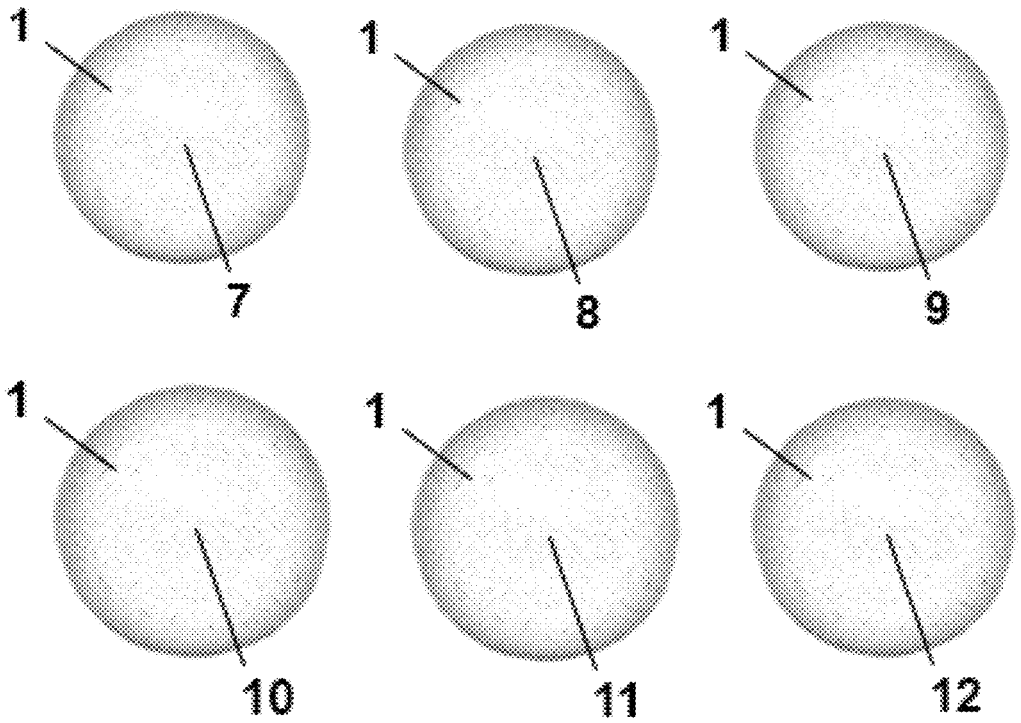
FIG. 5 illustrates and exposes each of the side of the ornamental earring backing 1, illustrated in FIG. 4.

In FIG. 5, we demonstrate that none of the six sides of the ornamental earring backing 1 contains a hole to accommodate the post of an earring. It is effectively illustrated that none of the six sides 7, 8, 9, 10, 11, 12 of the ornamental earring backing 1 has a hole.

FIG. 6 illustrates a standard earring 3 with its post 2 which is normally attached to an earring back-fastener with hole. We will use this earring 3 to explain the following figures.

Figure 7:
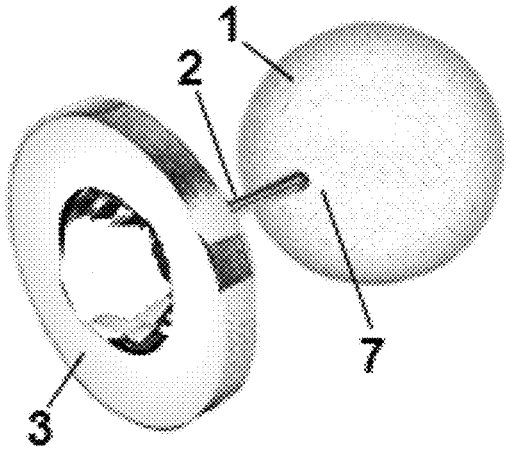
Figure 8:
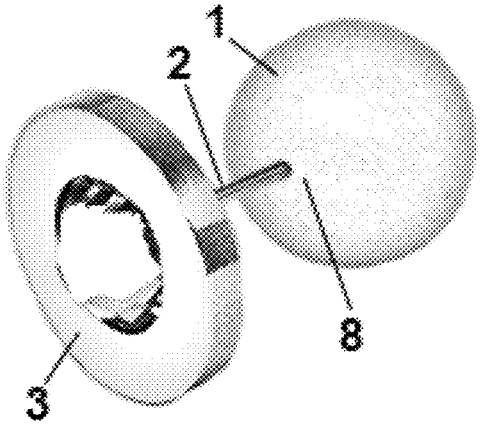
Figure 9:
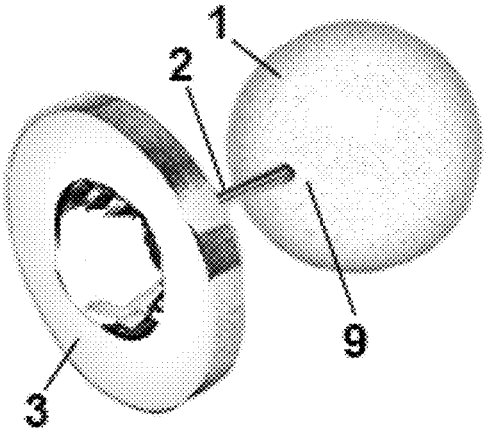
Figure 10:
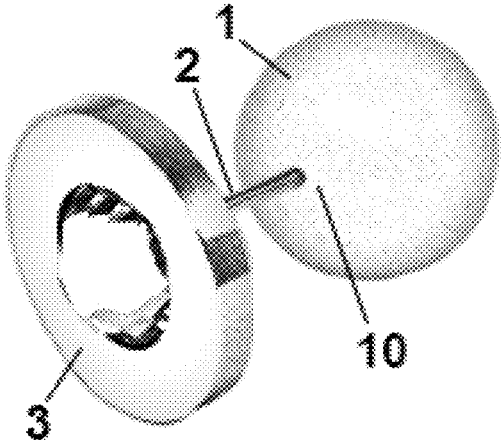

The inventiveness of claim 1) of our ornamental earring backing 1 is demonstrated by FIGS. 7 to 12 in which it is illustrated that the post 2 of the earring 3 is inserted and penetrates into each side without hole of the ornamental earring backing 1, that is to say the front side 7 in FIG. 7, the rear side 8 in FIG. 8, the top side 9 in FIG. 9, the bottom side 10 in FIG. 10, the left side 11 in FIG. 11 and finally the right side 12 in FIG. 12.

The invention claimed is:

1. A method of fastening an earring to a person's pierced earlobe using an earring backing, the method comprising, inserting an earring post through the pierce hole of the person's earlobe, said post being part of the earring, fixing the earring to said earring backing by penetrating the earring backing from any point on a surface of the earring backing, wherein said earring backing has no preexisting hole, wherein said backing consisting of an elastomer.

2. The method of fastening the earring of claim 1 wherein the elastomer is comprised of silicone, silicone rubber, or rubber.

3. The method of fastening the earring of claim 1, wherein the hardness of the elastomer is between 10 shore A and 90 shore A.

4. The method of fastening the earring of claim 3, wherein the hardness of the elastomer is between 20 shore A and 40 shore A.

5. The method of fastening the earring of claim 4, wherein the shape of the backing consisting any one of a sphere, a square, a rectangle, and a rhombus.

6. The method of fastening the earring of claim 3, wherein the shape of the backing consisting any one of a sphere, a square, a rectangle, and a rhombus.

7. The method of fastening the earring of claim 6, wherein the shape of the backing is a sphere, and further wherein said sphere having a diameter from 5 mm to 20 mm.

8. The method of fastening the earring of claim 7, wherein said diameter is from 10 mm to 20 mm.

9. An earring backing, said earring backing used for fastening an earring to a person's earlobe, said earring backing comprising, an elastomer, said elastomer having a hardness of between 10 shore A to 90 shore A, said earring backing having a shape, said shape having a surface or surfaces, said earring backing configured to grip and retain an earring post of the earring, wherein an entire surface area of said surface or surfaces is exposed such that any point on the surface or surfaces of said earring backing being available to be penetrated by the earring post, whereby the earring post is gripped and retained by said earring backing.

10. The earring backing of claim 9, wherein said shape having a volume between about 65.4 $mm^3$ to 4189 $mm^3$.

11. The earring backing of claim 10, wherein the hardness of the elastomer is between 20 shore A and 40 shore A.

12. The earring backing of claim 11, wherein the shape of the backing consisting of any one of a sphere, a square, a rectangle, and a rhombus.

13. The earring backing of claim 10, wherein the shape of the backing consisting of any one of a sphere, a square, a rectangle, and a rhombus.

* * * * *